United States Patent [19]

Elferink

[11] Patent Number: 4,777,734

[45] Date of Patent: Oct. 18, 1988

[54] METHOD AND AN APPARATUS FOR DRYING EGGS, FRUITS OR THE LIKE ARTICLES

[75] Inventor: Hendrik Elferink, Aalten, Netherlands

[73] Assignee: Staalkat B.V., Netherlands

[21] Appl. No.: 94,302

[22] Filed: Sep. 8, 1987

[51] Int. Cl.[4] ..... F26B 3/00

[52] U.S. Cl. ..... 34/34; 34/35; 34/160; 34/236

[58] Field of Search ..... 15/306 A, 316 R; 426/305; 34/160, 236, 219, 224, 225, 210, 216, 217, 233, 32, 34, 92, 35

[56] References Cited

U.S. PATENT DOCUMENTS 1,932,124 10/1933 Tobey ..... 34/12
4,291,472 9/1981 Lewis ..... 426/305
4,352,249 10/1982 Rose ..... 426/305

*Primary Examiner*—Henry A. Bennet
*Attorney, Agent, or Firm*—Griffin, Branigan & Butler

[57] ABSTRACT

A method of drying eggs, fruits or the like articles, in which water or other moisture is removed from the articles by blowing air at high speed along the articles, after which the water drops are removed from this air, and the air being subsequently passed again along the articles. Said air, after removal of the drops therefrom, is diverted along a blower or the like where it is pre-heated with heat dissipated from the blower and is again passed as pre-heated, unsaturated air along the articles.

7 Claims, 2 Drawing Sheets

METHOD AND AN APPARATUS FOR DRYING EGGS, FRUITS OR THE LIKE ARTICLES

This invention relates to a method for drying eggs, fruits or the like articles, in which water or other moisture is removed from the eggs by blowing air at high speed along the articles, after which the water drops are removed from this air.

In such a method and apparatus known from U.S. Pat. No. 1,932,124, the housing is divided into two compartments, in each of which there is arranged a roller conveyor, the boundary plane containing means for passing articles from the one compartment to the other. At the downstream end air is supplied via a heating element, after which said air is passed at high speed along the products, so that water is removed therefrom. The same air is then supplied, unprocessed, to the first compartment and is passed again along the products by means of a blower and subsequently discharged in an outward direction.

It is an object of the present invention to improve this method and to that end is characterized in that said air, after removal of the droplets therefrom, is diverted along a blower or the like where the air is pre-heated with heat dissipated from the blower and then is passed as pre-heated, unsaturated air, again along the articles, such as eggs. Therefore, first a removal of water from the products takes place by moving air at high speed therealong and the products are subsequently dried further by passing pre-heated, unsaturated air therealong.

In order to properly control the temperature, a part of said pre-heated, unsaturated air can be discharged and be replaced by fresh air so that the articles, such as eggs, are treated by air having the desired temperature.

The present invention further relates to an apparatus for drying eggs, fruits or the like articles, comprising a housing subdivided into a plurality of compartments through which at least a portion of the upper part of a roller conveyor extends, on which compartments there are provided air supply and discharge means which connect to each other at least partly, while at least one compartment is constructed in such a manner that air is moved at high speed along the articles.

It is an object of the present invention to improve such an apparatus disclosed in U.S. Pat. No. 1,932,124 and it is characterized to that end by means for moving air in the first compartment of the housing at high speed from the top along the products. The housing at that location is provided at its lower end with a fluid drain, while the air is sucked by the blower or blowers being heated by the waste heat of the blower(s) while flowing along said blower(s), which are in turn cooled, and subsequently is conducted in the next compartment of the chamber along the articles.

The housing may contain at least one blower whose outlet connects to a pressure box whose opposite and extends at least partly across the width of the upper part of the roller conveyor.

There is thus obtained a highly effective apparatus.

In a further elaboration of the present invention, the housing may be provided with a bypass extending from underneath the upper part of the roller conveyor along the blowers in upward direction, then along the top of the housing and thereafter again downwards towards the front of the housing in such a manner that the air can subsequently be sucked at high speed towards the roller conveyor, thereby producing a compact construction occupying little space in an egg sorting system.

For properly handling the products, such as eggs, the bypass can be provided at the top of the apparatus with an air discharge opening, and an air supply opening, respectively.

One embodiment of the apparatus for drying eggs according to the present invention will now be described, by way of example, with reference to the accompanying drawings, in which.

Figure 1:
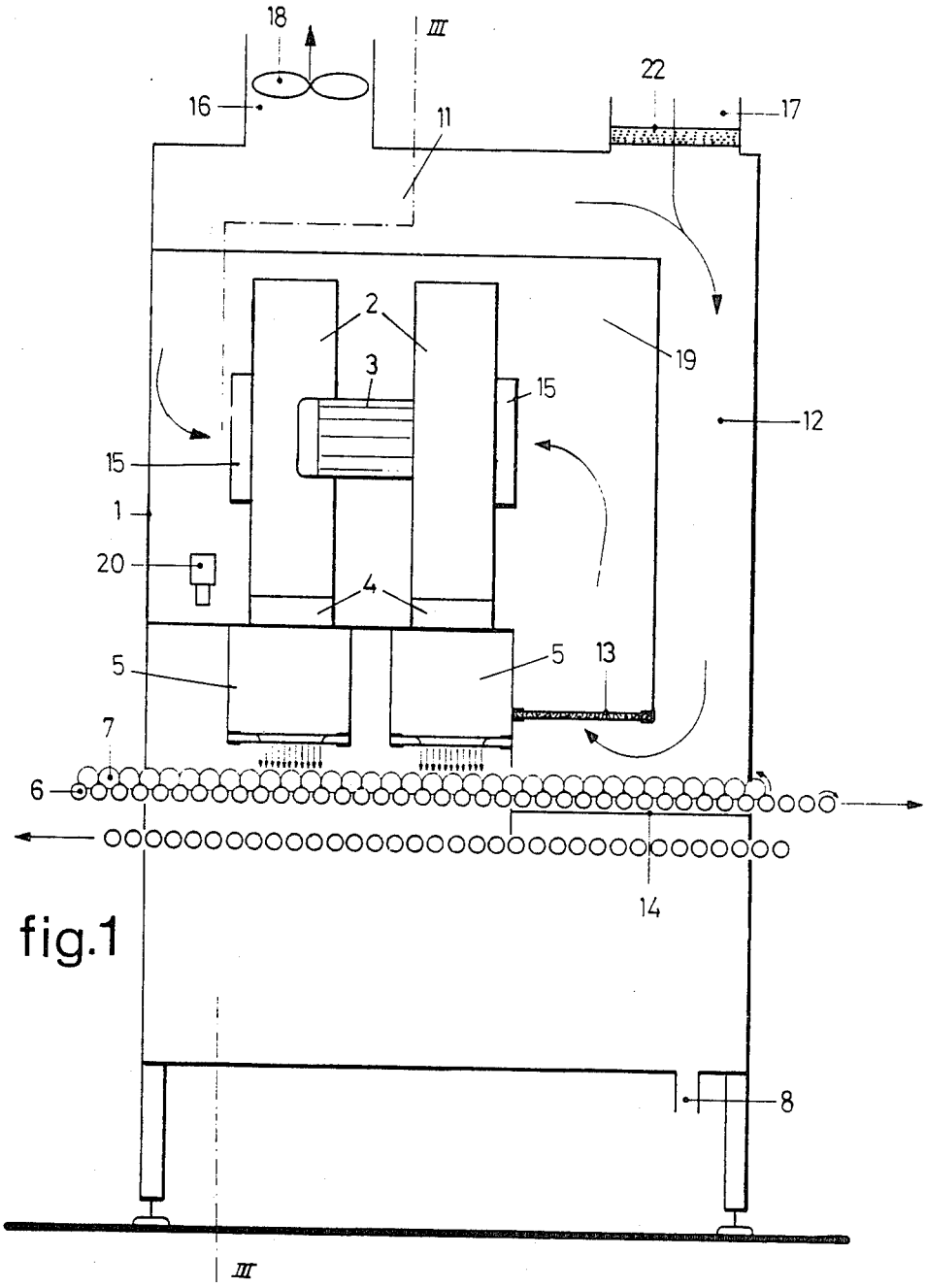
FIG. 1 is a longitudinal cross section of an apparatus for drying articles.
Figure 2:
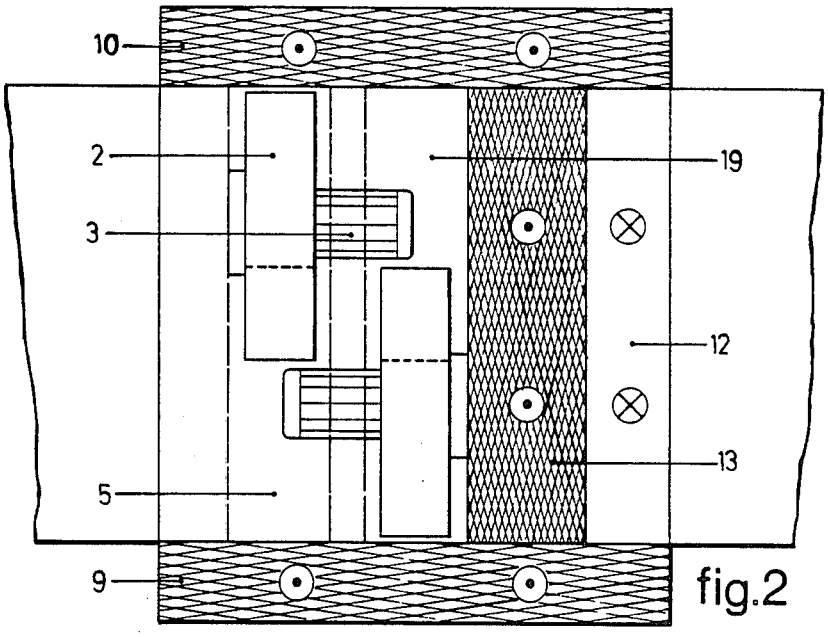
FIG. 2 is a top view of the apparatus shown in FIG. 1.

In the apparatus shown diagrammatically in the drawings there is also diagrammatically represented a roller conveyor with eggs lying thereon. Furthermore, the directions of movement of the air is indicated with arrows and small circles with a dot or cross, the circle with a dot indicating the direction of movement from the plane of the drawing upwards and the circle with cross indicating the direction of movement from the plane of the drawing downwards. The direction of the movement of the conveyor is also shown by arrows.

Figure 3:
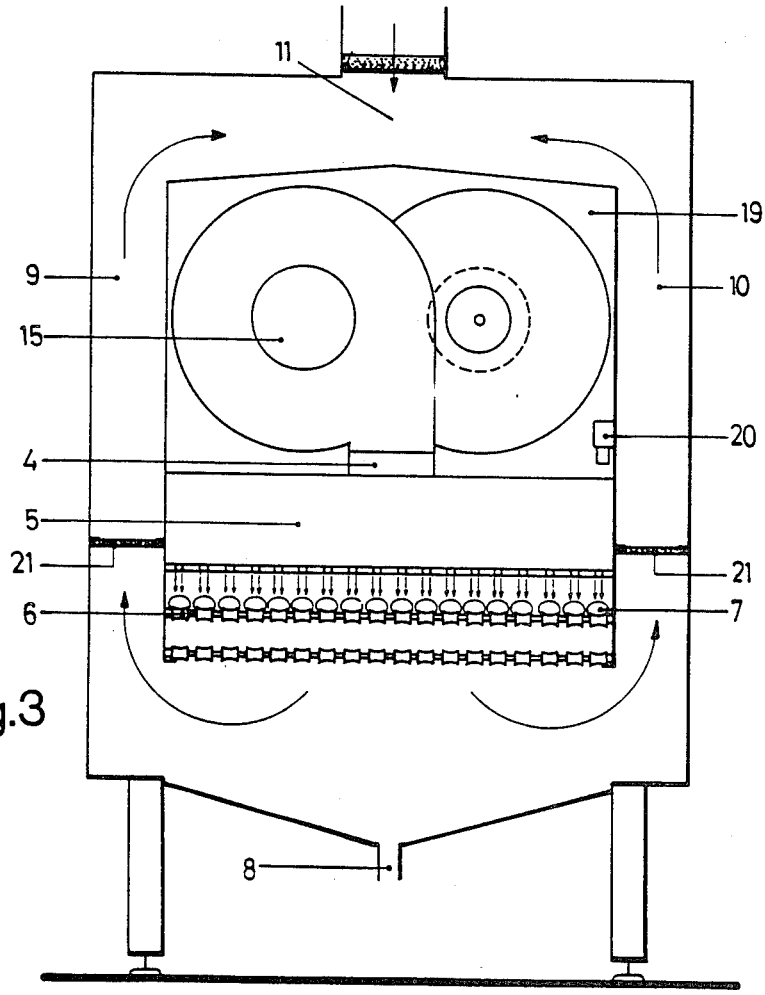
FIG. 3 is a cross sectional view on the line III—III of FIG. 1.

As shown in the drawings, an apparatus for drying eggs comprises a housing 1. In this case, the housing accomodates two blowers 2, each driven by a motor 3. Each blower outlet 4 connects to a pressure box 5. Such a pressure box is known per se, see e.g. U.S. Pat. No. 4,173,831. Each pressure box 5 extends transversely across the diagrammatically shown roller conveyor 6 extending through the housing, on which conveyor the eggs 7 to be dried are present. The housing underneath the pressure boxes 5 is provided with a fluid outlet 8. The housing further includes a bypass composed of lateral channels 9, 10 (see FIG. 3) extending from the space underneath the upper part of the roller conveyor 6 along the blower space 19 in upward direction by means of the overlying channel 11 and the downwardly oriented channel 12 to the eggs 7 on conveyor 6 (see FIG. 1), from which the air, after being deflected, flow partly as a result of the air guide plate 14, via the inlet. air filter 13 to the two inlets 15 of the blowers 2.

The temperature of the circulating air is controlled by means of thermostat controller 20, which starts the blower 18 disposed in a draw-off vent 16 connected to channel 11 at a maximum temperature limit to be set, said blower drawing off excess heat and humid air through vent 16. As a result, fresh cooling air will flow via grid 22 in channel 17. After the temperature has dropped sufficiently, the thermostat controller 20 will again stop the blower 18 so that there is no fresh air inflow through channel 17 any longer.

Similarly, numerous variants can be conceived within the scope of the present invention, consisting in the drying of articles by removal of moisture from the articles by moving air at high speed therealong and by using the same air, after heating, for "after-drying" as a result of air flow along motors and blowers being heated thereby. This results in a substantial saving in energy. Besides, the apparatus is highly compact, so that it can be easily incorporated in an egg handling line, while a third advantage consists in the simplicity of the construction according to the present invention.

What I claim is:

1. In a method of drying rows of articles such as eggs, fruits or the like disposed on a movable conveyor, in which water or moisture is removed from the articles by blowing air at high speed from at least one blower through the rows of the articles in a first zone, recovering the air and subsequently passing the air along the rows of articles in a second zone, the improvement comprises removing water drops from the recovered air in a compartment disposed below said conveyor to produce de-water air, diverting the de-water air through at least one channel disposed along said at least one blower whereby the air is heated with waste heat from the at least one blower, and subsequently passing the heated and thus unsaturated air along the articles at a speed less than the speed of the air passing through the rows of articles in the first zone for further drying thereof in said second zone.

2. In an apparatus for drying rows of articles such as eggs, fruits or the like wherein a housing is subdivided into a plurality of compartments through which at least a portion of an upper part of a conveyor extends and which conveyor is adapted to hold the said rows of articles, and air supply and discharge means are mounted in said compartments, which means are at least partially connected to each other, and wherien at least one first compartment is arranged in such a manner that air is moved from at least one blower through the rows of articles, the improvement comprising means for moving the air in the said first compartment at a first high speed through the rows of articles, means disposed below said conveyor for recovering the air and removing water drops therefrom to produce de-water air, means for diverting the de-water air along said at least one blower where the said air is heated by the waste heat from the said blower and thus rendered unsaturated, and means for subsequently passing the heated and unsaturated air to a next compartment and along the articles at a speed less than the speed of the air passing through the rows of articles in the first compartment.

3. A method as claimed in claim 1, wherein a part of said heated, unsaturated air is discharged and is replaced by fresh air so that the articles are treated by air having a desired temperature.

4. An apparatus as claimed in claim 2, wherein the housing accommodates at least one blower, the outlet of which connects to one end of a pressure box and the opposite end thereof extends at least partly across the width of the upper part of the conveyor.

5. An apparatus as claimed in claim 2 or 4, wherein the housing comprises a bypass extending from underneath the upper part of the roller conveyor along the blowers in an upward direction, along the top of the housing and thereafter downwards towards the front of the housing in such a manner that the air can then be blown at high speed towards the roller conveyor.

6. An apparatus as claimed in claim 5, wherein the bypass is provided at the top of the housing with an air discharge opening, and an air supply opening, respectively.

7. An apparatus as claimed in claim 4 or 5, wherein an inlet air filter is arranged in the said bypass at the downstream end.

* * * * *